United States Patent [19]

Shaw

[11] Patent Number: 4,690,752

[45] Date of Patent: Sep. 1, 1987

[54] SELECTIVE FLOCCULATION PROCESS FOR THE RECOVERY OF PHOSPHATE

[75] Inventor: Douglas R. Shaw, Arvada, Colo.

[73] Assignee: Resource Technology Associates, Boulder, Colo.

[21] Appl. No.: 719,343

[22] Filed: Apr. 3, 1985

Related U.S. Application Data

[63] Continuation of Ser. No. 524,889, Aug. 19, 1983, abandoned.

[51] Int. Cl.[4] ..... B03D 3/06

[52] U.S. Cl. ..... 209/5; 209/49; 209/167; 210/705; 210/907

[58] Field of Search ..... 209/5, 49, 166, 167; 210/704, 705, 725, 727, 732, 734, 907

[56] References Cited

U.S. PATENT DOCUMENTS

| | | | |
|---|---|---|---|
| 2,660,303 | 11/1953 | Haseman | 209/5 |
| 3,020,231 | 2/1962 | Colwell et al. | 210/732 |
| 3,302,785 | 2/1967 | Greene | 209/5 |
| 3,314,537 | 4/1967 | Greene | 209/5 |
| 3,670,883 | 6/1972 | Weir | 209/5 |
| 3,837,482 | 9/1974 | Sheridan, III | 209/5 |
| 4,194,969 | 3/1980 | Chung et al. | 209/166 |
| 4,235,709 | 11/1980 | Baudet et al. | 209/5 |
| 4,265,770 | 5/1981 | Thomas | 210/715 |
| 4,298,169 | 11/1981 | Iwasaki | 209/166 |
| 4,555,329 | 11/1985 | Sykes et al. | 209/5 |

OTHER PUBLICATIONS

"Dispersion-Flocculation Characteristics of Florida Phosphate Slimes", A. F. Colombo, Bureau of Mines, Minnesota, U.S.A.

Friend et al., "The Separation of Minerals from Mixtures by Selective Flocculation", Filtration & Separation, Jan.-Feb., 1972, pp. 25-28.

*Primary Examiner*—Peter Hruskoci

*Attorney, Agent, or Firm*—Sheridan, Ross & McIntosh

[57] ABSTRACT

A process for separating and recovering non-metallic minerals, particularly phosphate, from an ore containing non-uniform sized particles, including colloidal particles. The ore is slurried in an alkaline, aqueous solution with a dispersing agent. A flotation collector is added, and the mixture is contacted with a hydrophobic, high molecular weight, nonionic polymer to flocculate the fine particles and make them amenable to subsequent flotation. A second embodiment provides a process for the recovery of an upgraded non-metallic ore from ore slimes, such as phosphate slimes, utilizing a high molecular weight, polyacrylamide, anionic flocculating agent.

6 Claims, No Drawings

SELECTIVE FLOCCULATION PROCESS FOR THE RECOVERY OF PHOSPHATE

This is a continuation of application Ser. No. 524,889, filed Aug. 19, 1983, now abandoned.

FIELD OF THE INVENTION

This invention is a minerals beneficiation process involving selective flocculation for the recovery of non-metalic minerals from slimes and feed materials of non-uniform particle sizes including slimes, and in particular, is a process for the recovery of phosphate from phosphate ores which have not been subjected to desliming.

BACKGROUND OF THE INVENTION

This invention provides an improved and simplified process for the treatment of non-metallic minerals, particularly phosphate, contained in an ore in which the starting particle size of the ore for processing ranges from about minus 20 mesh to colloidal size. Flocculation and flotation are known methods for treating ores, but non of the prior methods have been successful in providing an economical and simplified method for treating ore containing a significant fraction comprising a fine particle size, e.g. less than about 10 microns.

In particular, phosphate ores contain substantial quantities of very fine particles which renders treatment and recovery of the desired phosphate difficult. In known treatment methods for phosphate ore, the ore is first sized and then separated into a sand fraction and a waste slime portion. The particle size of the sand fraction typically ranges from about minus 20 mesh to about plus 150 mesh. The fine particles, minus 150 mesh down to colloidal size, are the rejected waste slime portion. This waste slime portion, containing approximately 10 to 40% of the phosphate contained in the starting ore material, is discharged into environmentally undesirable tailings ponds. Known methods of treating the slimes have typically involved processing them after separation from the larger sands. U.S. Pat. No. 4,235,709 discloses a treatment by selective flocculation for the fine fraction of phosphate ores. This patent teaches conditioning the ore with sodium silicate prior to the addition of water and a subsequent flocculation agent consisting of a cellulose derivative. U.S. Pat. No. 2,660,303 teaches a process of adding a sodium hydroxide dispersant to the slime, followed by starch to selectively flocculate the phosphate and recover it for separation. U.S. Pat. No. 3,302,785 discloses a process for treating Tennessee phosphate slimes by negative ion froth flotation followed by desliming the tailings and combining the tailings with the froth concentrate to provide an electric furnace feed. The process is not applicable to Florida phosphate slimes due to the lack of plus 325 mesh phosphate agglomerates in the Florida slimes. A. F. Colombo in "Dispersion-Flocculation Characteristics of Florida Phosphate Slimes," a U.S. Bureau of Mines report, discloses treating an alkaline, aqueous slurry comprising phosphate waste slimes at pH 8.5 to 10 with a dispersant and subsequently with a high anionic functionality cornstarch as a flocculating agent to recover 60–70 percent of the phosphate product, upgraded 2 to 5 percent. None of the above references teaches the advantage of utilizing an ore having a non-uniform particle size as a feed material for selective flocculation utilizing a nonionic flocculation agent. In addition, none of the references teach the use of a hydrophobic selective flocculating agent.

It is therefore, the object of the present invention to improve non-metallic mineral recoveries over those obtainable by known conventional methods.

A further object of this invention is to provide an improved and simplified method for phosphate recovery from phosphate ores by utilizing both coarser sands and previously waste slimes and subjecting the starting phosphate feed material to a selective flocculation process utilizing a hydrophobic flocculating agent.

A still further object of this invention is to provide an improved and simplified process for phosphate recovery from phosphate waste slime tailings.

The process of the present invention provides an excellent overall phosphate recovery of an upgraded product from a non-uniform size ore containing fine and colloidal size particles, previously unattainable in, for example, the Florida phosphate processing industries. Utilizing the minus 150 mesh to colloidal size particles of the ore according to the methods of the present invention increases phosphate yield and reduces tailing disposal problems now encountered in the Florida phosphate industries. Moreover, ore slimes, the minus 150 mesh to colloidal size particles, now contained in tailings ponds can be added to the larger sized particles to reclaim the approximately 10 to 40% phosphorus contained in the slimes.

SUMMARY OF THE INVENTION

The present invention involves a process for separating and recovering non-metallic minerals, particularly phosphate, from an ore which has been sized to a non-uniform size range, from about minus 20 mesh to colloidal particles. The sized ore is slurried with an alkaline, aqueous solution with a dispersing agent present. The non-metallic minera is separated and recovered from the ore when the slurry is treated by a selective hydrophobic flocculating agent, followed by conventional flotation methods, preferably in multiple stages.

In another embodiment of this invention, slimes previously separated from the larger ore particles are treated with selected dispersants and flocculating agents to recover an upgraded phosphate product.

DETAILED DESCRIPTION OF THE PREFERRED EMBODIMENT

This invention relates a process for the recovery of non-metallic minerals, particularly phosphate, from an ore containing said minerals, in which the particle size of the ore is from about minus 20 mesh down to colloidal sizes. The fine particles of the ore, the minus 150 mesh to colloidal size, are particularly beneficiated by the process of this invention for recovering of the desired non-metallic mineral.

As a broad concept, the process steps involve sizing the ore to obtain a size range from about minus 20 mesh to minus 150 mesh. The ore is then preferably washed with deionized water and a slurry is formed with the addition of the water. The ratio of solids to liquids is selected to allow effective dispersal of the ore particles and yet provide frequent enough collisions of the particles after treatment with the flocculating agent to form recoverable agglomerates. Preferably the ratio of solids to liquids is at most about 40%, and more preferably between about 20% and about 30%. A dispersing agent, such as sodium silicate or sodium hydroxide, is added to the aqueous solution. If a non-alkaline dispersing agent is used, then the pH of the solution is adjusted to a pH of about 9 to 11, preferably around 10. After mixing the slurry with the dispersant, a flotation collector such as sodium oleate, vapor oil, or other collector known to the art, is added to render the coarser ore particles hydrophobic. Next, a selective hydrophobic flocculating agent, preferably polyethylene oxide (PEO), is added to the slurry. The polyethylene oxide will selectively agglomerate the finer ore particles and render them hydrophobic. The non-metallic mineral concentrate is recovered in a froth concentrate after bubbling air into the slurry following conventional froth flotation procedures.

More specifically, the ore, suitable for obtaining the desired non-metallic mineral, is conventionally prepared by crushing and/or grinding typically to less than minus 20 mesh. Preferably, the ore is ground to less than minus 48 mesh. The particle size distribution of the crushed ore will typically be about 78% minus 20 to plus 150 mesh; and 22% minus 150 mesh. Alternatively, the desired ore particle sizes may be generated by the ore mining methods, or be due to the inherent physical characteristics of the ore. For example, in conventional Florida phosphate processing the phosphate is not typically ground. Instead, the phosphate ore is sized by use of a 20 mesh screen and a cyclone, and the ore size typically utilized for processing is sand ranging in size from minus 20 to plus 150 mesh, with the minus 150 mesh size slimes constituting reject tailings. In the method of a preferred embodiment of this invention, both the sands and the slimes constitute the starting ore feed material.

The sized ore is then slurried with water or an aqueous solution, the percentage of solids being preferably between about 20 and 30%. The water used is preferably obtained from the slimes portion of the feed. Dispersants are next added to the slurry, such as sodium silicate and sodium hydroxide. As will be known and understood by those skilled in the art, other dispersing agents serving the same purpose may be used. This dispersing agent is added in an amount sufficient to promote uniform and maximum separation of the particles, including the extremely fine particles, preferably in a ratio of dispersant to solids from about 2 to about 5 lbs/ton of ore and most preferably from about 2 to about 3 lbs/ton of ore. The pH of the slurry should be alkaline, preferably in the range of about 9 to 11, most preferably at least about 10. The slurry is mixed for a short period of time, preferably from about 1 to about 3 minutes, for a time sufficient to adequately mix all of the reagents within the slurry.

A flotation collector is then added to the dispersed mixture in an amount sufficient to render the coarser ore particles hydrophobic for later flotation. Flotation collectors known to the art, such as sodium oleate, vapor oil, tall oil and the like are suitable, and are preferably added at a ratio of collector to solids of between about 0.5 and about 4 lbs/ton of ore, and most preferably between about 1 and about 2 lbs/ton of ore. Agitation of the mixture is then conducted, preferably at high speed, to ensure the coating of all ore particles capable of being coated with the hydrophobic collector.

The conventional flotation collector does not completely coat the fine particles of the slimes contained in the slurry, however, and therefore a hydrophobic flocculating agent is selected for addition to the slurry at this point. The hydrophobic flocculating agent is preferably a high molecular weight nonionic polymer, most preferably polyethylene oxide, which is added in an amount sufficient to selectively flocculate or agglomerate all the non-metallic mineral fines present. Flocculation produces larger agglomerated fines of a particle size range and chemical environment permitting recoveries by froth flotation. Preferably the polyethylene oxide is added at a ratio of flocculating agent to solids from about 0.1 to about 2 lbs/ton of ore, and most preferably from about 0.3 to about 0.4 lb/ton of dry ore. This slurry is mixed gently so as not to break up the formed floccules for a short period of time after the addition of the polyethylene oxide.

Air is then bubbled through the mixture, preferably for about 12 minutes at a rate of about 5 liters/minute to selectively attach to the hydrophobic particles, and form a froth concentrate containing the desired mineral values. Phosphate recoveries in the rougher concentrate of at least about 93% are achievable by the process of this invention.

The dispersion, flocculation, and flotation steps are performed preferably at ambient temperature and pressure.

In a preferred embodiment, the flocculation and flotation steps are conducted in a continuous multiple stage process.

Preferably the rougher flotation concentrate is cleaned in at least two stages to produce a phosphate concentrate having at least 66–67% BPL, with an overall phosphate recovery of at least about 70%. Tailings formed in the first cleaning stage can be recirculated to rougher flotation or to final tailings.

Alternatively, in the methods according to this invention, waste slime tailings can be added to the starting feed material. Phosphate ore generally comprises approximately 80% sand to 20% slime. This invention provides a process such that the slime percentage in the starting phosphate ore feed material can be increased, with the addition of tailings pond slime, for recovery of the previously unrecoverable phosphate content.

In another embodiment of this invention, slurries comprising only extremely fine ore particles, such as Florida phosphate slimes unmixed with coarser ore fractions, are treated by selective flocculation to recover an upgraded phosphate product.

In the treatment of such slimes, the solid content is adjusted, if necessary to between about 10 and about 30%, and most preferably between about 15 and about 25% solids.

A dispersing agent is then added, in an amount sufficient to achieve separation of the fine particles, preferably at a ratio of dispersant to solids of between about 5 and about 10 lbs/ton, and most preferably between about 6 to about 8 lbs/ton. The dispersant should be a low molecular weight polyacrylate such as Cyquest 3223, to avoid the effects of sodium dispersants in attracting clay particles. The pH is adjusted to at least about 10 with a pH adjusting agent such as potassium hydroxide, and the mixture is agitated to disperse the particles.

Next a flocculating agent is added comprising a high molecular weight anionic polymer such as Separan MG 500, a polyacrylamide product of Dow Chemical Company. The flocculating agent is added in an amount sufficient to agglomerate a major portion of the fine ore particles, preferably at a ratio of flocculating agent to solids of between about 0.1 and about 1.0 lbs/ton of slimes, more preferably between about 0.3 and about 0.5 lbs/ton of slimes. The mixture is gently agitated for a short period of time, preferably about 3 minutes, to allow the agglomerates to form, but not subsequently break up.

The slurry is then allowed to settle for a short period of time, typically from a few minutes to about one-half hour, while the phases disengage, and movement within the slurry is stopped.

At this point the disengaged slimes may optionally be siphoned off the top of the mixture. Typically about two-thirds of the water and up to 60% alumina is removed with the slimes. The flocculated phase, typically containing about 20–30% solids, remains in the lower portion of the mixture.

An upgraded phosphate product is then recovered by flotation methods from the flocculated phase.

Alternatively, the flocculated mixture is not deslimed, but is treated by conventional froth flotation methods to recover a high phosphate froth concentrate.

The following examples are by way of illustration, not by way of limitation.

EXAMPLE 1

The feed material used in Examples 1 through 6 was analyzed, with results shown in Table 1.

TABLE 1

| Mineral | Wt % | Composition |
|---|---|---|
| Carbonate-fluorapatite | 20–25 | $Ca_{10}(PO_4,CO_3)_6P_{2-3}$ |
| Quartz | 30–35 | $SiO_2$ |
| Montmorillonite | 20–25 | $(Fe,Al,Mg)_2(Al,Si)_4O_{10}(OH)_2(Ca,Na)$ |
| Attapulgite | 5–10 | $(Mg,Al,Fe)_5(Al,Si)_6O_{20}(OH)_28H_2O$ |
| Wavellite | 4–6 | $Al_3(OH)_3(PO_4)_25H_2O$ |
| Feldspar | 2–3 | $KAlSi_3O_8 + NaAlSi_3O_8$ |
| Others (zircon, garnet, rutile, kaolinite, iron oxide, organics) | 0–3 | — |

As used with these Examples, slimes are feed material described as minus 150 mesh (Tyler screen sieve). The sands are feed material described as minus 20 to plus 150 mesh.

Typical particle sizing for phosphate slimes is 95% minus 20 microns, 85% passing 10 microns, and 60–70% finer than 1 micron. Phosphate distributions are of like percentages since the concentration of $P_2O_5$ tends to be uniform across the particle size range. The slimes may be considered as essentially colloidal.

Typical particle sizing for the sands is minus 20 mesh by 150 mesh.

EXAMPLE 2

Testing was done to evaluate the effect on phosphate recovery when the starting feed ore constituted 80% by weight sands (minus 20 to plus 150 mesh) and 20% by weight slimes (minus 150 mesh). 700 grams of the material were slurried to a pulp density of 25% solids and sodium silicate was added as a dispersant in the amount of 3 lbs/ton of ore. A flotation collector consisting of sodium oleate was then added in the amount of 1 to 2 lbs/ton of ore, and the slurry was vigorously agitated. PEO was then added in the amount of 0.3 to 0.4 lbs/ton of ore, and after gentle mixing, air was bubbled into the mixture and the rough froth concentrate collected.

In the first rough phosphate concentrate of the flotation process, before cleaning, the phosphate recovery was 79%. After cleaning of the concentrates by the methods described above, the final product assayed 65% BPL (bone phosphate of lime) with a recovery of 68% phosphate.

Additional testing was done using the same test procedures and starting ratios of feed material with the variation of grinding of the plus 48 mesh fraction of the ore sand feed to provide better liberation of the locked quartz/fluorapatite particles. This testing produced phosphate recoveries of as much as 93% in the rougher phosphate concentrates. The cleaned product assayed 67% BPL, with a phosphate recovery of 70%.

Assay/size analysis showed in a very high recovery of phosphate from all particle sizes, particularly in the minus 400 mesh slime range where the recovery of phosphate was over 92%. Study of the kinetics of phosphate flotation showed that the flocculated phosphate slimes were consistently recovered preferably ahead of the individual phosphate grains.

EXAMPLE 3

A series of tests were conducted to evaluate the effect of varying the slimes concentration in the starting feed ore on phosphate recovery. The percentage of slimes in the starting feed ore was varied utilizing 90/10, 80/20, 70/30, and 60/40 sands/slimes ratios.

For a baseline control, each varying starting feed ore was tested both by the flocculation and flotation process as described in Example 1, and by conventional flotation processing. Table 1 illustrates the results attained from this test.

TABLE 1

| Sand/ | | Cleaner Concentrate | | | Rougher Concentrate | | | Tailings | |
|---|---|---|---|---|---|---|---|---|---|
| Slime Weight | Test Conditions | Wt % | % BPL | BPL Recovery % | Wt % | % BPL | BPL Recovery % | % BPL | BPL Distribution, % |
| 100 | Conventional | 16.6 | 66.1 | 48.6 | 27.4 | 44.9 | 54.3 | 4.91 | 30.00 |
| 100 | Conventional | 14.0 | 44.9 | 25.8 | 35.0 | 32.6 | 46.7 | 20.1 | 53.3 |
| 90/10 | Conventional | 7.5 | 47.6 | 21.5 | 13.0 | 39.0 | 30.6 | 13.3 | 69.4 |
| 90/10 | Flocculation | 18.0 | 67.1 | 68.2 | 25.2 | 55.7 | 79.1 | 4.96 | 20.9 |
| 80/20 | Conventional | 10.2 | 39.7 | 22.3 | 23.9 | 30.9 | 40.5 | 14.3 | 59.5 |
| 80/20 | Flocculation | 18.9 | 64.9 | 68.8 | 36.3 | 77.3 | 78.6 | 6.77 | 21.4 |
| 80/20 | Flocculation | 17.5 | 66.5 | 70.1 | 42.2 | 36.7 | 92.6 | 2.42 | 7.4 |
| 80/20 | Flocculation | — | — | — | 52.7 | 31.1 | 95.7 | 1.60 | 4.3 |
| 70/30 | Conventional | 10.3 | 39.7 | 22.3 | 23.9 | 30.9 | 40.5 | 14.3 | 59.5 |
| 70/30 | Flocculation | 49.6 | 24.1 | 65.6 | 70.1 | 21.5 | 82.7 | 10.6 | 17.3 |
| 60/40 | Conventional | 12.9 | 35.4 | 23.8 | 28.2 | 30.1 | 44.2 | 15.0 | 55.8 |
| 60/40 | Flocculation | 52.8 | 22.7 | 64.6 | 68.6 | 22.2 | 82.0 | 10.7 | 18.0 |

EXAMPLE 4

The starting feed was 200 grams of phosphate slimes of minus 150 mesh. The feed was mixed with deionized water to a pulp density of 15% solids, and 6 lbs/top of ore of Cyquest 3223 as a dispersing reagent was added to the mixture. The pH was adjusted to about 10. The slurry was mixed for 3 minutes with moderate shear force. Next, 0.4 lbs/ton of Separan MG 500 was added as a flocculating agent. The flocculant was mixed in with the slurry for a short period of time sufficient to allow complete mixing, and then the solution was allowed to settle and the two phases to separate. The two phases were a top layer slime phase, comprising fine clay particles, and a lower concentrate phase, comprising the phosphate floccules. The slime phase was removed as waste and not further processed.

Five consecutive selective flocculation and desliming stages were conducted. The flocculated concentrate assayed 30% BPL with a recovery of phosphate of over 81%. The combined five slime products (waste) represented 44 weight percent and assayed 8.7% BPL (equivalent to 4% $P_2O_5$). This indicated a large increase in the rejection of clay slimes (over 25% rejection previously obtained with only one flocculating and desliming stage) and a corresponding increase in phosphate upgrading in the flocculated phase. The selectivity of flocculation of phosphate fines from clays was, therefore, increased by prolonged and repeated contact of the flocculant with slimes.

The test products were analyzed for various elements to determine the distribution of the major minerals in selective flocculation. The results, presented in Table 2, show that approximately 60% of the alumina (clays) and silica (quartz, feldspars) gangue constituents were rejected to the waste slime by selective flocculation. Between 78 and 83% of calcium and fluorine constituents of the phosphate mineral, fluropatite, reported to the flocculated concentrate. This is consistent with the 81% BPL recovery in this product.

TABLE 2

| Product | Weight % | BPL | Distribution, % Ca | $H_2CO_3$ | $CO_2$ | F | Mg | $Al_2O_3$ | $SiO_2$ |
|---|---|---|---|---|---|---|---|---|---|
| Flocculated conc | 56.23 | 81.4 | 83.3 | 79.3 | 91.3 | 78.5 | 65.7 | 41.3 | 43.8 |
| 5th Slime | 7.62 | 3.9 | 3.7 | 4.4 | 2.4 | 4.5 | 6.6 | 9.8 | 9.6 |
| 4th Slime | 9.76 | 4.0 | 3.5 | 4.5 | 2.2 | 4.7 | 7.8 | 13.0 | 12.9 |
| 3rd Slime | 11.15 | 3.8 | 3.5 | 4.5 | 1.6 | 4.5 | 8.9 | 15.2 | 14.5 |
| 2nd Slime | 9.48 | 3.3 | 2.9 | 4.2 | 1.1 | 4.0 | 7.2 | 13.3 | 12.2 |
| 1st Slime | 5.76 | 3.6 | 3.1 | 3.1 | 1.4 | 3.8 | 3.8 | 7.4 | 7.0 |
| Head (calc) | 100.00 | 100.0 | 100.0 | 100.0 | 100.0 | 100.0 | 100.0 | 100.0 | 100.0 |
| Combined slimes | 43.77 | 18.6 | 16.7 | 20.7 | 8.7 | 21.5 | 34.3 | 58.7 | 56.2 |

EXAMPLE 5

The multiple stage selective flocculation process of Example 4 was reproduced on another similar sample of phosphate slimes from a Florida operation. After four stages of selective flocculation and desliming, the flocculated concentrate assayed 32% BPL with a phosphate recovery of over 82%. The total slimes rejected assayed 14% BPL at a weight rejection of 32%. The higher BPL assay of the slime reject reflected the 26% BPL head assay of this sample in contrast to about 20% BPL for the previous sample.

EXAMPLE 6

Two flotation tests of the highly agglomerated phosphate fines of Example 5 were conducted using a conventional mechanical flotation machine and a column aspirated with finely divided air bubbles. The tests used a conventional fatty acid and vapor oil collector scheme, but the mechanical test also used PEO prior to flotation. The froth products, which assayed 35% BPL, were only slightly higher than the 30% BPL flotation feed. Phosphate recoveries in the conventional and column tests, respectively, were 55% and 44% from the original slimes feed which assayed 20% BPL.

A further test was conducted with flocculation but without desliming of the clays prior to flotation to determine the effect of clay slimes removal on phosphate flotation. This gave only marginal phosphate upgrading and very poor recoveries.

What is claimed is:

1. A process for separating an upgraded phosphorus ore from an aqueous slurry containing said phosphorus ore comprising particles from about minus 20 to about minus 150 mesh, comprising:

(a) contacting the slurry at a pH of at least about 10 with a dispersing agent selected from the group consisting of sodium silicate, sodium hydroxide and polyacrylate in an amount sufficient to achieve dispersion in the slurry of substantially all the ore particles;

(b) contacting the dispersed mixture of step (a) with a flotation collector in an amount sufficient to coat and render hydrophobic substantially all the ore particles capable of being coated therewith;

(c) vigorously agitating the mixture of step (b) to achieve said coating;

(d) contacting the mixture of step (c) with a hydrophobic nonionic polyethylene oxide in an amount sufficient to cause the agglomeration of substantial portions of the fine particles of about minus 150 mesh;

(e) gently mixing the mixture of step (b) to provide dispersion of the polyethylene oxide of step (d) and form said agglomerates without significantly breaking up said agglomerates;

(f) subjecting the mixture of step (e) to froth flotation by the addition of gas bubbles thereto;

(g) separating the phosphorus-rich froth concentrate from the mixture of step (f).

2. The process according to claim 1 in which the particle size of said ore ranges from about 500 to about 10 microns.

3. The process according to claim 1 in which the solids to solution ratio in said aqueous slurry is between about 10% and about 30%.

4. A process for recovering a phosphorus ore upgraded by at least about 5% phosphate content from a phosphate slime containing clays and said phosphorus ore comprising particles of about minus 150 mesh in an aqueous slurry of a ratio of solids to liquids of between about 10% and about 30%, comprising:

(a) adjusting the pH of said aqueous slurry to a pH of at least about 10;

(b) contacting said slurry with a dispersing agent selected from the group consisting of sodium silicate, sodium hydroxide and polyacrylate in an amount sufficient to disperse the fine particles in the slurry;

(c) contacting said slurry with an anionic polyacrylamide in an amount sufficient to agglomerate a substantial portion of the fine ore particles to the exclusion of the clay particles;

(d) allowing the mixture of step (c) to separate into an upper slime phase and a lower flocculate concentrate phase;

(e) contacting the concentrate phase with a flotation collector in an amount sufficient to coat and render hydrophobic substantially all of the ore particles capable of being coated therewith;

(f) subjecting said concentrate phase to froth flotation by the addition of gas bubbles thereto; and (g) separating the phosphorus-rich froth concentrate from said concentrate phase.

5. The process of claim 4 in which the dispersing agent is a low molecular weight polyacrylate.

6. The process of claim 4 in which phosphate is recovered from particles of from about 10 microns to about 500 microns in size.

* * * * *